United States Patent [19]

Mink

[11] Patent Number: 4,512,231

[45] Date of Patent: Apr. 23, 1985

[54] VIOLIN CONSTRUCTION

[76] Inventor: Paul K. Mink, 575 E. Ave. East, Wendell, Id. 83355

[21] Appl. No.: 589,594

[22] Filed: Mar. 14, 1984

[51] Int. Cl.[3] ..... G10D 3/02

[52] U.S. Cl. ..... 84/277; 84/309

[58] Field of Search ..... 84/274–277, 84/309

[56] References Cited

U.S. PATENT DOCUMENTS 4,343,220 8/1982 Lundquist ..... 84/313

FOREIGN PATENT DOCUMENTS 5325 of 1912 United Kingdom ..... 84/309

*Primary Examiner*—Lawrence R. Franklin

*Attorney, Agent, or Firm*—Seed and Berry

[57] ABSTRACT

An acoustical instrument in which the back and belly of the instrument are allowed to vibrate independently. The instrument is constructed with a hollow body having a back, a belly, and sides which connect the back to the belly. One of the feet of the bridge rests on the belly, while the other foot is supported by a bridge stabilizer, one end portion of the bridge stabilizer mounted on the surface of the belly, the other end portion mounted on the upward end of a sound-post. The sound-post is positioned such that it extends downward from the belly and passes through the belly without touching the same. The downward end of the sound-post terminates at and is mounted to the back.

5 Claims, 4 Drawing Figures

FIG. 1
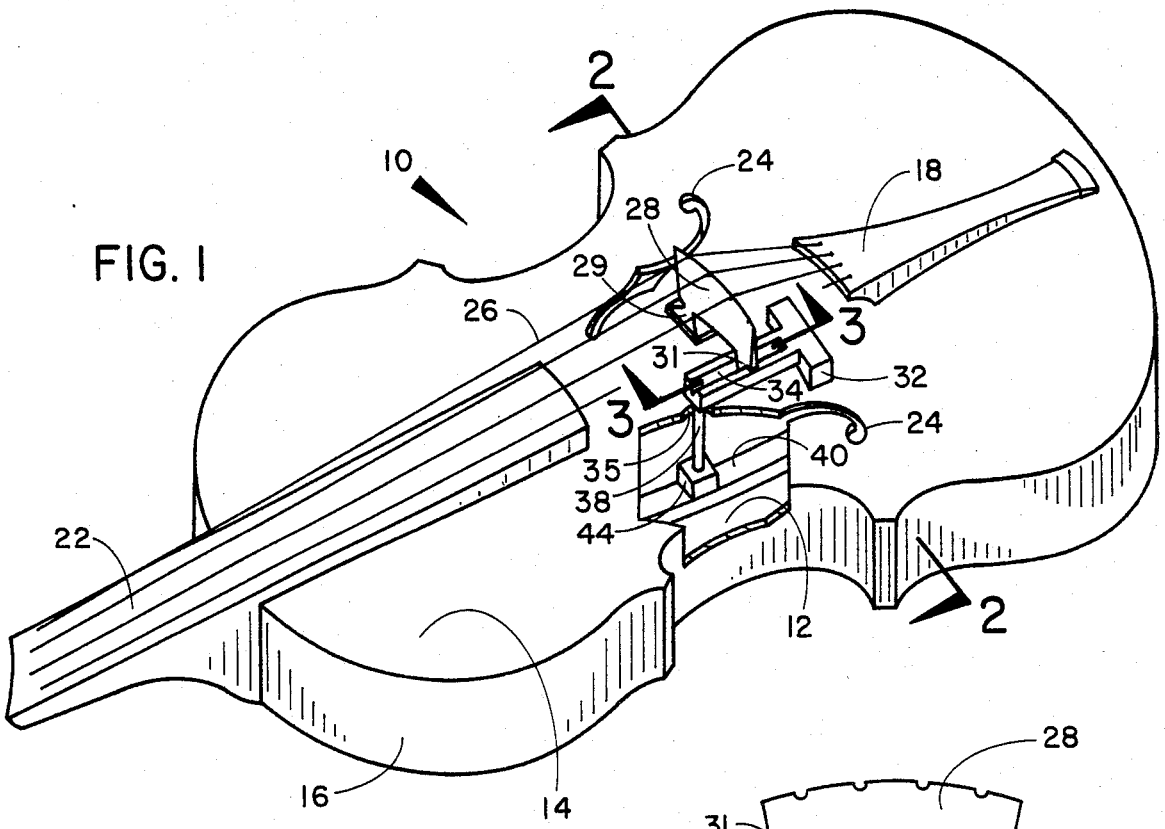
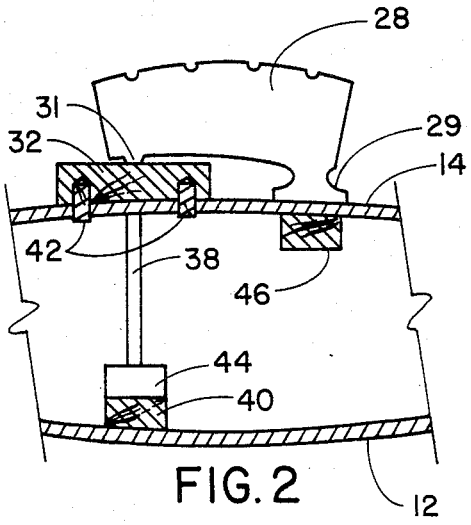
FIG. 2
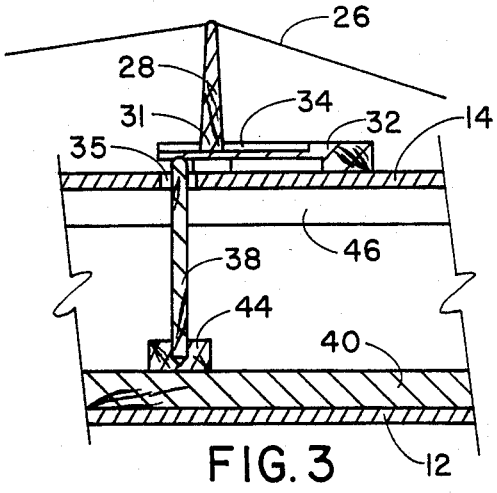
FIG. 3
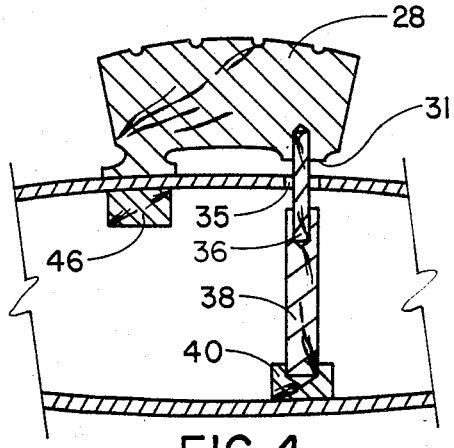
FIG. 4

VIOLIN CONSTRUCTION

DESCRIPTION

1. Technical Field

The present invention relates to acoustical instruments in general, and more specifically, to a modification in the construction of acoustical instruments such that the back and belly of the instrument are allowed to vibrate independently.

2. Background Art

Acoustical instruments have traditionally been constructed so that the feet of the bridge rest upon and are supported by the belly of the instrument, as in U.S. Pat. No. 1,623,667. A variation on the traditional design is illustrated in U.S. Pat. No. 1,497,998 in which a counter-bridge is employed to function as a pivot to permit the bridge of the instrument to vibrate in a precise rocking movement, indirectly causing the air in the body of the instrument to be alternately compressed and expanded. This is said to increase the regularity of vibration of the body. Another known design is disclosed in U.S. Pat. No. 1,193,279 in which the bridge of the instrument is provided with a third foot, which extends directly from the bridge to the back through the F opening.

However, while these alternative designs have, in certain instances, been an advance over the traditional manner of constructing violins, the problem of dissonance created by the conflicting vibrations of the belly in relation to the back of the instrument remain, thus causing a decrease in the resultant timbre.

Accordingly, it is the primary object of the present invention to provide an improved acoustical instrument construction which eliminates this problem and further provides other related advantages.

DISCLOSURE OF THE INVENTION

Briefly stated, the present invention consists of an improved design for an acoustical stringed instrument in which the back and belly of the instrument are allowed to vibrate independently.

This improved design may be utilized with a variety of acoustical stringed instruments, such as violins, guitars, mandolins, bass fiddles, and violas.

In one embodiment of the invention, the improved design includes a bridge having two feet, where one of the feet is resting directly on the belly, and the other of the feet is supported directly by a sound-post. The sound-post passes through the belly without touching the same, and extends downward from the belly, terminating at and mounted to the back. One modification of this embodiment includes the addition of a bridge stabilizer. The bridge stabilizer is mounted on the surface of the belly and is adapted to receive one foot of the bridge and one end of the sound-post such that the bridge and the sound post form a substantially contiguous relationship.

BRIEF DESCRIPTION OF THE DRAWINGS

FIG. 1 is a fragmentary perspective view of a violin illustrating and showing one embodiment of the invention.

FIG. 2 is an enlarged fragmentary sectional view taken substantially along line 2—2 of FIG. 1.

FIG. 3 is an enlarged fragmentary sectional view taken substantially along line 3—3 of FIG. 1.

FIG. 4 is an enlarged vertical cross-sectional view illustrating an alternative embodiment of the invention.

BEST MODE FOR CARRYING OUT THE INVENTION

In reference to FIG. 1, acoustical instrument 10 includes a back 12 positioned opposite a belly 14, with sides or ribs 16 forming the remainder of the enclosure branching between the back and the belly. The back, belly, and sides, as well as other components of the instrument, may be constructed of a variety of materials, both artificial and natural, such as walnut, spruce, mahogany, or maple. As traditionally designed in the art, acoustical or bow instrument 10 is also provided with a tailpiece 18 and fingerboard 22, both of which are positioned on the surface of the belly, as well as a pair of F-shaped openings 24 formed through the surface of the belly. A series of strings 26 extend longitudinally from the tailpiece 18 and terminate at a saddle (not shown). The strings 26 are supported by a bridge 28, one foot 29 of which is in contact with the surface of the belly 14. The bridge 28 serves to communicate the vibration of the strings 26 to the belly of the instrument.

As noted above, one foot 29 of the bridge rests upon the surface of the belly 14. In one embodiment of the invention, as shown in FIGS. 1 and 2, the other foot 31 of the bridge rests upon and is supported by a bridge stabilizer 32. Bridge stabilizer 32 is provided with a guiding slot 34 which is adapted to slidably receive foot 31 of the bridge. It is preferable to have the shape of the foot 31 mateable with the shape of the guiding slot 34 such that the two form a relationship in which the maximum surface contact between the two components is obtained, thus facilitating the transfer of vibrations between the two. The guiding slot 34 forms a continuous groove along a portion of the surface of the bridge stabilizer 32 to allow the bridge 28 to slidably move longitudinally along the path of the strings 26.

Referring now to FIGS. 2 and 3, bridge 28 is shown with foot 29 supported by the belly of the instrument, while foot 31 is slidably received and supported by the bridge stabilizer 32. As shown in FIG. 2, bridge stabilizer 32 is held securely in place at the end nearest the tailpiece 18 by means of retaining pins 42 which extend from the bridge stabilizer into the surface of the belly 14. The underside of the bridge stabilizer 32 is also adapted to receive the upper end of the sound-post 38. The sound-post extends downward from and substantially perpendicular to the belly without touching the same, and terminates at a sound bar 40 which is securely mounted to the back 12. Alternatively, a divider of sound-post base 44 may be positioned between the sound-post and the sound bar. In both alternatives, the sound-post is removable.

Turning now to FIG. 4, an alternative embodiment which does not utilize a bridge stabilizer, is illustrated. As shown in FIG. 4, the foot 31 of the bridge 28 rests upon and is supported by a pin 36 which extends downward from the bridge, the pin passing through an aperture 35 in the belly without touching the same. The pin 36 is, in turn, supported by the upper end of sound-post 38. The lower end of the sound-post 38 is held by a sound bar 40 which is secured to the back of the instrument.

From the foregoing, it will be appreciated that, although specific embodiments of the invention have been described herein for purposes of illustration, various modifications may be made without deviating from the spirit and scope of the invention. Accordingly, the invention is not to be limited except as by the appended claims.

I claim:

1. An acoustical instrument in which the back and belly of the instrument are allowed to vibrate independently, comprising the combination of:

a hollow body having a back, a belly, and sides, said sides connecting said back to said belly; and a bridge having two feet, one of said feet supported by and resting on the belly, the other of said feet supported by a bridge stabilizer, one end of said bridge stabilizer forming a portion of the belly, the other end of the bridge stabilizer mounted to the upper end of a sound-post, said sound-post extending from said belly to said back.

2. An acoustical instrument in which the back and belly of said instrument are allowed to vibrate independently, comprising the combination of:

a hollow body having a back, a belly, and sides, said sides connecting said back to said belly, a bridge having two feet, one of said feet supported by and resting on the belly, the other of said feet supported by a bridge stabilizer, a sound-post passing through said belly without touchng same, and extending from said belly to said back, said bridge stabilizer mounted on the surface of said belly and adapted to receive one foot of said bridge and one end of said sound-post such that said bridge and said sound-post form a substantially contiguous relationship.

3. The invention as defined in claim 2 wherein said bridge stabilizer is held securely in place on the surface of said belly by at least one retaining pin positioned to simultaneously project through the belly and into the bridge stabilizer.

4. The invention as defined in claim 2, including a sound-post base positioned between and acting as a connector for one end of the sound post and the back.

5. An acoustical instrument in which the back and belly of said instrument are allowed to vibrate independently, comprising the combination of:

a hollow body having a back, a belly, and sides, said sides connecting the back to the belly, a bridge having two feet, one of said feet supported by and resting on the belly, the other of said feet supported by a bridge stabilizer, one end portion of said bridge stabilizer mounted on the surface of said belly, the other end portion of the bridge stabilizer mounted to the upper end of a sound-post, said sound-post passing through said belly without touching the same, and extending from said belly to said back.

* * * * *